US006789622B1

(12) United States Patent
Ducasse et al.

(10) Patent No.: US 6,789,622 B1
(45) Date of Patent: Sep. 14, 2004

(54) APPARATUS FOR AND A METHOD OF ANCHORING AN EXPANDABLE CONDUIT

(75) Inventors: Christopher Ducasse, Aberdeen (GB); Peter Oosterling, Berkel en Roderijs (NL)

(73) Assignee: EZ Tech Limited, Houston, TX (US)

( * ) Notice: Subject to any disclaimer, the term of this patent is extended or adjusted under 35 U.S.C. 154(b) by 0 days.

(21) Appl. No.: 10/069,990

(22) PCT Filed: Sep. 6, 2000

(86) PCT No.: PCT/GB00/03407

§ 371 (c)(1),
(2), (4) Date: Jul. 8, 2002

(87) PCT Pub. No.: WO01/18355

PCT Pub. Date: Mar. 15, 2001

(30) Foreign Application Priority Data

Sep. 6, 1999 (GB) ..... 9920936

(51) Int. Cl.[7] ..... E21B 43/10; E21B 23/00
(52) U.S. Cl. ..... 166/277; 166/206; 166/207
(58) Field of Search ..... 166/277, 207, 166/208, 206

(56) References Cited

U.S. PATENT DOCUMENTS

| | | | | |
|---|---|---|---|---|
| 1,880,218 | A | * 10/1932 | Simmons | 166/382 |
| 2,017,451 | A | * 10/1935 | Wickersham | 285/37 |
| 3,353,599 | A | * 11/1967 | Swift | 166/278 |
| 3,529,667 | A | * 9/1970 | Malone | 166/387 |
| 3,776,307 | A | 12/1973 | Young | |
| 5,494,106 | A | * 2/1996 | Gueguen et al. | 166/277 |
| 6,085,838 | A | * 7/2000 | Vercaemer et al. | 166/277 |
| 6,098,717 | A | * 8/2000 | Bailey et al. | 166/382 |
| 6,425,444 | B1 | * 7/2002 | Metcalfe et al. | 166/387 |
| 6,431,282 | B1 | * 8/2002 | Bosma et al. | 166/288 |
| 6,457,532 | B1 | * 10/2002 | Simpson | 166/380 |
| 6,497,289 | B1 | * 12/2002 | Cook et al. | 166/380 |
| 6,527,049 | B2 | * 3/2003 | Metcalfe et al. | 166/277 |
| 6,598,678 | B1 | * 7/2003 | Simpson et al. | 166/297 |
| 2002/0014339 | A1 | * 2/2002 | Ross | 166/380 |
| 2002/0066576 | A1 | * 6/2002 | Cook et al. | 166/380 |
| 2003/0042022 | A1 | * 3/2003 | Lauritzen et al. | 166/277 |
| 2003/0042028 | A1 | * 3/2003 | Lauritzen et al. | 166/384 |
| 2003/0047323 | A1 | * 3/2003 | Jackson et al. | 166/380 |
| 2003/0102127 | A1 | * 6/2003 | Braddick | 166/277 |
| 2003/0106696 | A1 | * 6/2003 | Lauritzen et al. | 166/380 |

FOREIGN PATENT DOCUMENTS

| | | |
|---|---|---|
| EP | 0881354 | 12/1998 |
| EP | 0961007 | 12/1999 |
| GB | 2345308 | 7/2000 |
| WO | WO 0061914 | 10/2000 |

* cited by examiner

*Primary Examiner*—David Bagnell
*Assistant Examiner*—Thomas S Bomar
(74) *Attorney, Agent, or Firm*—Moser, Patterson & Sheridan, L.L.P.

(57) ABSTRACT

The present invention provides apparatus and a method of anchoring an expandable conduit. A formation is provided on an outer surface of the conduit, the formation comprising a number of bands of a friction and/or sealing material. When the expandable conduit is radially expanded, the friction and/or sealing material engages a second conduit in which the expandable conduit is located. The engagement of the friction and/or sealing material provides an anchor for the expandable conduit.

19 Claims, 4 Drawing Sheets

APPARATUS FOR AND A METHOD OF ANCHORING AN EXPANDABLE CONDUIT

CROSS REFERENCE TO RELATED APPLICATIONS

This application is the U.S. national phase application of PCT International Application No. PCT/GB00/03407, filed Sep. 6, 2000.

FIELD OF THE INVENTION

The present invention relates to apparatus for and a method of anchoring an expandable conduit, particularly, but not exclusively, to a second conduit in which the expandable conduit is located.

BACKGROUND OF THE INVENTION

A borehole is conventionally drilled during the recovery of hydrocarbons from a well, the borehole typically being lined with a casing that is cemented into place. Casings are installed to prevent the formation around the borehole from collapsing. In addition, casings prevent unwanted fluids from the surrounding formation from flowing into the borehole, and similarly, prevent fluids from within the borehole escaping into the surrounding formation.

It is known to use a pliable casing that can be radially expanded so that an outer surface of the casing contacts the formation around the borehole. The pliable casing undergoes plastic deformation when expanded, typically by passing an expander device, such as a ceramic or steel cone or the like, through the casing. The expander device is propelled along the casing in a similar manner to a pipeline pig and may be pushed (using fluid pressure for example) or pulled (using drill pipe, rods, coiled tubing, a wireline or the like).

Lengths of expandable casing are coupled together (typically by threaded couplings) to produce a casing string. The casing string is inserted into the borehole in an unexpanded state and is subsequently expanded using the expander device. However, the unexpanded casing string requires to be anchored either at an upper end or a lower end thereof before and/or during the expansion process.

SUMMARY OF THE INVENTION

According to a first aspect of the present invention, there is provided apparatus for anchoring an expandable conduit, the apparatus comprising at least one formation provided on an outer surface of the expandable conduit, the formation being capable of engaging a second conduit in which the expandable conduit is located, the formation providing an anchor and/or seal for the expandable conduit when the expandable conduit is at least partially expanded.

According to a second aspect of the present invention, there is provided a method of anchoring an expandable conduit, the method comprising the steps of providing an expandable conduit having at least one formation on an outer surface thereof, the formation being capable of engaging a second conduit in which the expandable conduit is located to provide an anchor and/or seal for the expandable conduit, anchoring the expandable conduit to the second conduit, and expanding at least a portion of the expandable conduit to force the formation into contact with the second conduit.

The invention also provides expandable conduit such as casing or the like, the conduit having a formation on its outer surface adapted to engage a second member when the expandable conduit is expanded.

The formation typically comprises resilient material, typically first and second bands of a first resilient material such as rubber, the first and second bands being axially spaced apart, with a third band of a second resilient material such as a second rubber being located between the first and second bands. The first material is preferably harder than the second material. The first and/or second materials may be profiled on an outer surface thereof to enhance anchoring and/or sealing.

In one specific embodiment of the invention, the first and second bands comprise 2 inch (approximately 51 millimeters) wide bands, spaced apart by 10 inches (approximately 250 millimeters). The third band typically comprises a 10 inch (approximately 250 millimeters) wide band. The first rubber is typically a 60 durometer rubber. The second rubber is typically a 40 durometer rubber. The bands of rubber can be of any suitable hardness and width. Alternatively, the first rubber can be a 90 durometer rubber, and the second rubber can be a 60 durometer rubber.

In an alternative embodiment, the formation comprises a band of rubber or other suitable resilient material. The band preferably defines a zigzag pattern on the outer surface of the conduit. The rubber can be of any suitable hardness, but is typically in the order of 40 to 90 durometers, although values of hardness outwith this range may also be used.

The material properties and configuration of the or each formation can be chosen to suit the particular application.

The expandable conduit typically comprises an expandable casing or liner. However, the expandable conduit may be any suitable expandable pipe or the like.

The formation is optionally detachable and preferably applied to the outer surface of the conduit before the conduit is expanded. The formation optionally comprises two or more axially spaced formations.

The second conduit typically comprises a borehole, casing, liner or the like. The expandable casing may engage any type of conduit.

The method of the invention typically includes the additional step of providing an expander device to radially expand the expandable conduit.

The expander device typically comprises a cone. The expander device may be manufactured from steel. Alternatively, the expander device may be manufactured from a ceramics material, or a combination of steel and a ceramics material. The expander device is optionally flexible.

The expandable conduit is typically temporarily anchored to the second conduit using a mechanical or other anchoring device (e.g. a slip).

BRIEF DESCRIPTION OF THE DRAWINGS

Embodiments of the present invention shall now be described, by way of example only, with reference to the accompanying drawing in which.

DETAILED DESCRIPTION OF THE INVENTION

Figure 1:
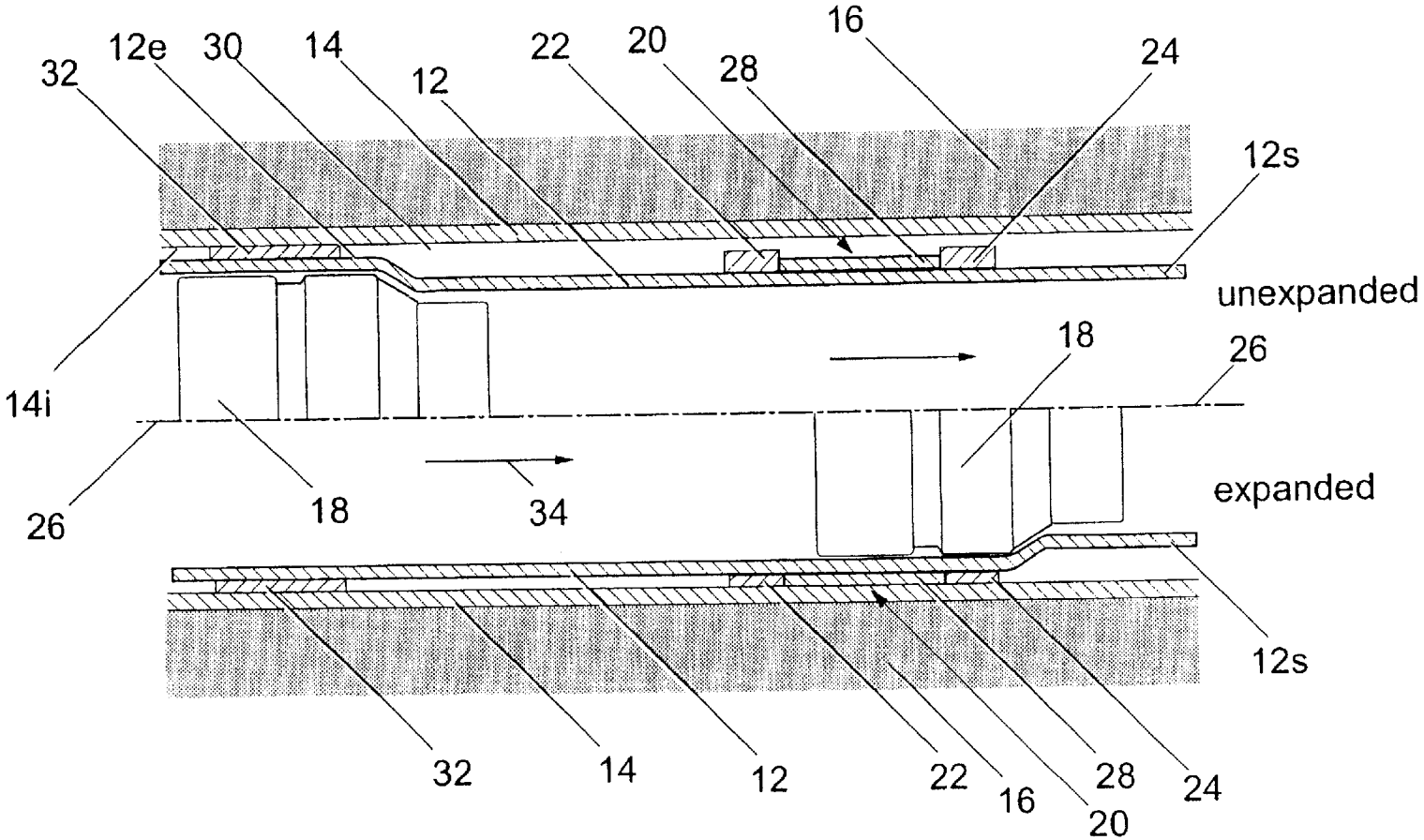
FIG. 1 is a schematic cross-section of an exemplary embodiment of apparatus for anchoring an expandable conduit to a borehole.

Referring to the drawing, FIG. 1 shows an exemplary embodiment of apparatus for anchoring an expandable conduit 12. The expandable conduit 12 is shown located within a casing or liner 14. Conventionally, casing or liner 14 is used to line or case a borehole that is drilled into a formation 16 to facilitate the recovery of hydrocarbons. It should be noted however, that the expandable conduit 12 may be a liner or casing used to case or line the borehole.

The expandable conduit 12 may be any type of suitable conduit that is capable of sustaining plastic deformation whereby it can be radially expanded by at least 10%, although it may be radially expanded by a value more or less than this.

The upper portion of FIG. 1 shows the expandable conduit 12 in unexpanded form, with an expander device 18 located therein used to impart a radial expansion force. The lower portion of FIG. 1 shows a portion of the expandable conduit 12 radially expanded by the expander device 18.

The expander device 18 typically comprises a cone. The expander device 18 may be manufactured from steel, or alternatively may be manufactured from a ceramics material, or a combination of steel and a ceramics material. The expander device 18 is optionally flexible, although this is advantageous where the expander device 18 is required to expand an expandable conduit that includes a curvature or the like. Any conventional type of expander device 18 may be used.

As shown in FIG. 1, the expandable conduit 12 is provided with at least one formation, generally designated 20, (only one formation 20 shown in FIG. 1) on an outer surface 12*s* thereof. The formation 20 typically comprises first and second bands 22, 24 that are axially spaced apart along a longitudinal axis 26 of the expandable conduit 12. The first and second bands 22, 24 are typically axially spaced by some distance, for example 10 inches (approximately 250 mm). The first and second bands 22, 24 are preferably annular bands that extend circumferentially around the outer surface 12*s* of the expandable conduit 12, although this configuration is not essential. The first and second bands 22, 24 typically comprise 2 inch wide (approximately 51 mm) bands of a first type of rubber. The formation 20 need not extend around the full circumference of the surface 12*s*.

Located between the first and second bands 22, 24 is a third band 28 of a second type of rubber. The third band 28 preferably extends between the first and second bands 22, 24 and is thus typically 10 inches (approximately 250 mm) wide.

The first and second bands 22, 24 are typically of a first depth. The third band 28 is typically of a second depth. The first depth is typically larger than the second depth, although they may be the same. Thus, the first and second bands 22, 24 protrude further from the surface 12*s* than the third band 28, as shown schematically in FIG. 1.

The first type of rubber (i.e. first and second bands 22, 24) is preferably of a harder consistency than the second type of rubber (ie third band 28). The first type of rubber is typically 60 durometer rubber, whereas the second type of rubber is typically 40 durometer rubber. Durometer is a conventional hardness scale for rubber.

The particular properties of the rubber may be of any suitable type and the hardnessess quoted are exemplary only. It should also be noted that the relative dimensions and spacings of the first, second and third bands 22, 24, 28 are exemplary only and may be of any suitable dimensions and spacing.

Figures 2A, 2B, 2C:
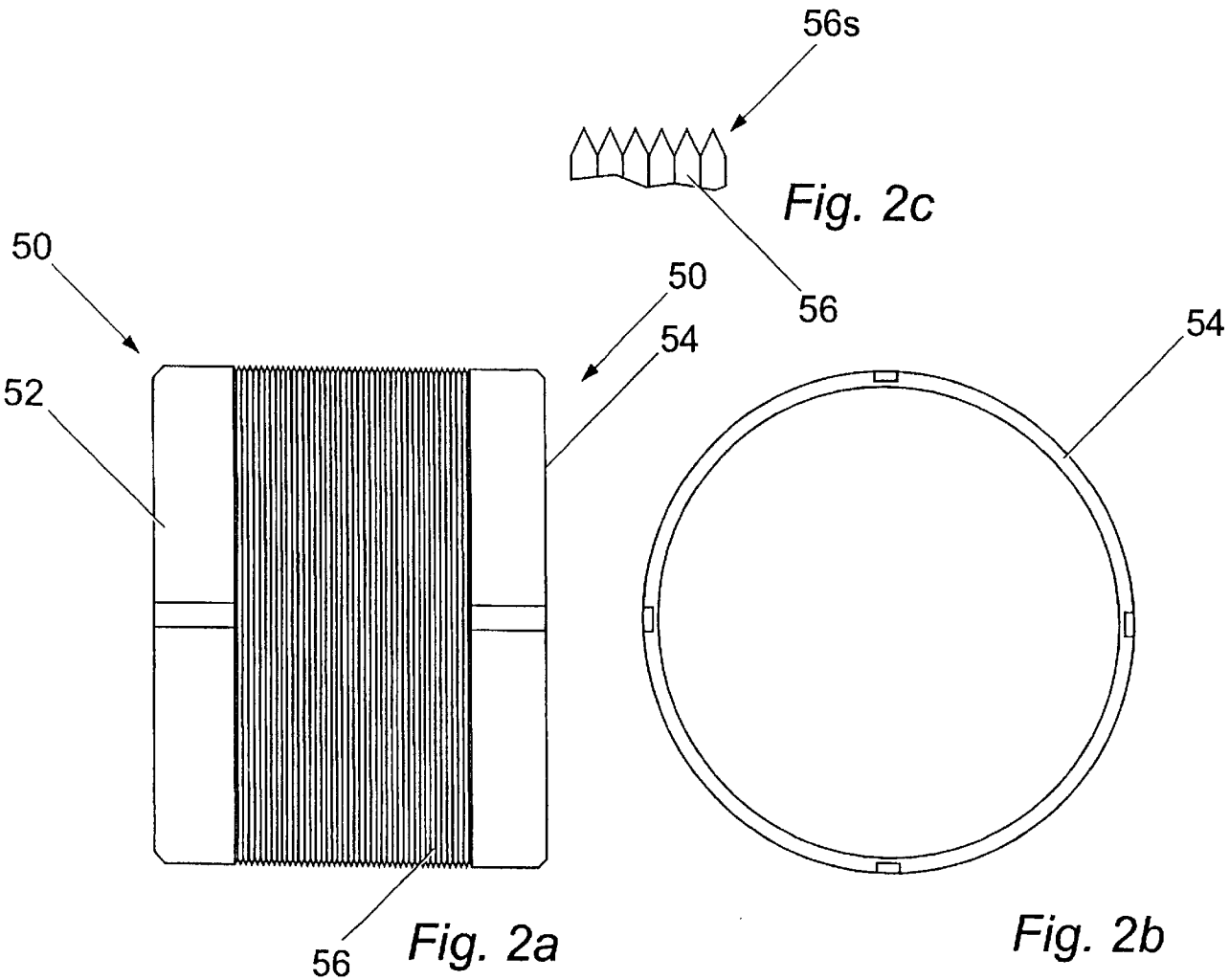
FIG. 2*a* is a front elevation showing a first configuration of a formation applied to an outer surface of the apparatus of FIG. 1.
FIG. 2*b* is an end elevation of the formation of FIG. 2*a;*
FIG. 2*c* is an enlarged view of a portion of the formation of FIGS. 2*a* and 2*b* showing a profiled outer surface.

Referring to FIGS. 2*a* to 2*c*, there is shown an alternative formation 50 that is substantially the same, as formation 20. In the embodiment shown in FIGS. 2*a* to 2*c*, the formation 50 comprises first and second bands 52, 54 of a first resilient material, with a third band 56 of a second resilient material located therebetween.

The first and second bands 52, 54 are around 1 inch (approximately 25.4 mm) wide, and are spaced-apart by around 3 inches (approximately 76 mm); the third band 56 is thus 3 inches wide.

The first resilient material of the first and second bands 52, 54 is typically harder than the second resilient material of the third band 56. In the embodiment shown in FIGS. 2*a* to 2*c*, the first resilient material comprises a rubber with a 90 durometer hardness, and the second resilient material comprises a rubber with a 60 durometer hardness.

Unlike formation 20, the depths of the bands 52, 54, 56 are substantially the same. As can be seen from FIG. 2*c* in particular, an outer face 56*s* of the third band 56 can be profiled. The outer face 56*s* is ribbed to enhance the grip of the third band 56 on an inner face of a second conduit (e.g. a preinstalled portion of liner, casing or the like, or a wellbore formation) in which the expandable conduit 12 is located. It will be appreciated that an outer surface on the first and second bands 52, 54 may also be profiled (e.g. ribbed).

The two outer bands 52, 54 being of a harder rubber provide a relatively high temperature seal and a backup seal to the relatively softer rubber of the third band 56. The third band 56 typically provides a lower temperature seal.

In use, the formation 20, 50 is applied to the outer surface 12*s* of the (unexpanded) expandable conduit 12.

The formation 20, 50 may be applied at axially spaced-apart locations along the length of the expandable conduit 12, the spacings and number of formations 20, 50 being chosen to suit the particular application.

The expandable conduit 12 is then run into a borehole, casing or liner 14, or some other conduit onto which the expandable conduit 12 is to be attached. As can be seen in FIG. 1 (upper portion) when the expandable conduit 12 is run into the casing or liner 14, an annulus 30 is created between the outer surface 12*s* of the expandable conduit 12 and an inner surface 14*i* of the casing or liner 14. The expander device 18 is typically located in an expanded portion 12*e* of the expandable conduit 12 before the conduit 12 is run into the casing or liner 14. It should be noted that the conduit 12 is of the non-interference type wherein the annulus 30 remains (although reduced in size) even when the expandable conduit 12 is radially expanded ie there is a gap between the expandable conduit 12 and the casing or liner 14. Expandable conduit 12 need not be of the non-interference type.

As the outer surface 12*s* of the expandable conduit 12 is not in direct contact with the inner surface 14*i* of the casing or liner 14, a mechanical or other type:of anchoring device 32 (e.g. a slip) is used to provide a temporary anchor whilst at least a portion of the expandable conduit 12 is radially expanded. The mechanical or other type of anchoring device 32 may be of any conventional type and is typically attached at, or near, the expanded portion 12*e* of the expandable conduit 12.

When the mechanical or other type of anchoring device 32 is set, the expander device 18 is pushed or pulled through the expandable conduit 12 in the direction of arrow 34. The expander device 18 may be propelled through the expandable conduit 12 using fluid pressure, or may be pigged along the expandable conduit 12 using a conventional pig or tractor (not shown). The expander device 18 may alternatively be propelled using a weight (from a string for example), or may by pulled through the expandable conduit 12 (e.g. using drill pipe, rods, coiled tubing, a wireline or the like).

As the expander device 18 is propelled along the expandable conduit 12 (using any conventional means), it radially expands the conduit 12, as illustrated in the lower portion of FIG. 1. As the conduit 12 is expanded, the formation 20, 50 is also expanded whereby the formation 20, 50 (i.e. first, second and thirdbands 22, 24, 28, 52, 54, 56 of rubber) engage with a portion of the inner surface 14*i* of casing or liner 14. It is advantageous to have an outer surface of the first and second rubbers (i.e. bands 22, 24, 52, 54), and optionally the third rubber (i.e. band 28, 56), profiled (e.g. ribbed or the like) to enhance the anchoring and/or sealing.

As the first, second and third bands 22, 24, 28, 52, 54, 56 of rubber engage the inner surface 14*i* of the casing or liner 14, they provide an anchor point due to the friction caused between the first and/or second rubbers and the inner surface 14*i*. This anchor point anchors the expandable conduit 12 to the casing or liner 14.

Additionally, the first and/or second rubbers may also act as a seal that results in an annular pressure seal that seals the annulus 30. Where two or more formations 20, 50 are provided at axially spaced-apart locations, the portions of the annulus 30 between the formations 20, 50 will be isolated from one another.

After the formation 20, 50 has been expanded whereby the first and second rubbers provide at least an anchor point for the expandable casing 12 (and optionally a seal for annulus 30), the mechanical or other type of anchoring device 32 can be released, and optionally removed from the casing or liner 14.

Figure 3:
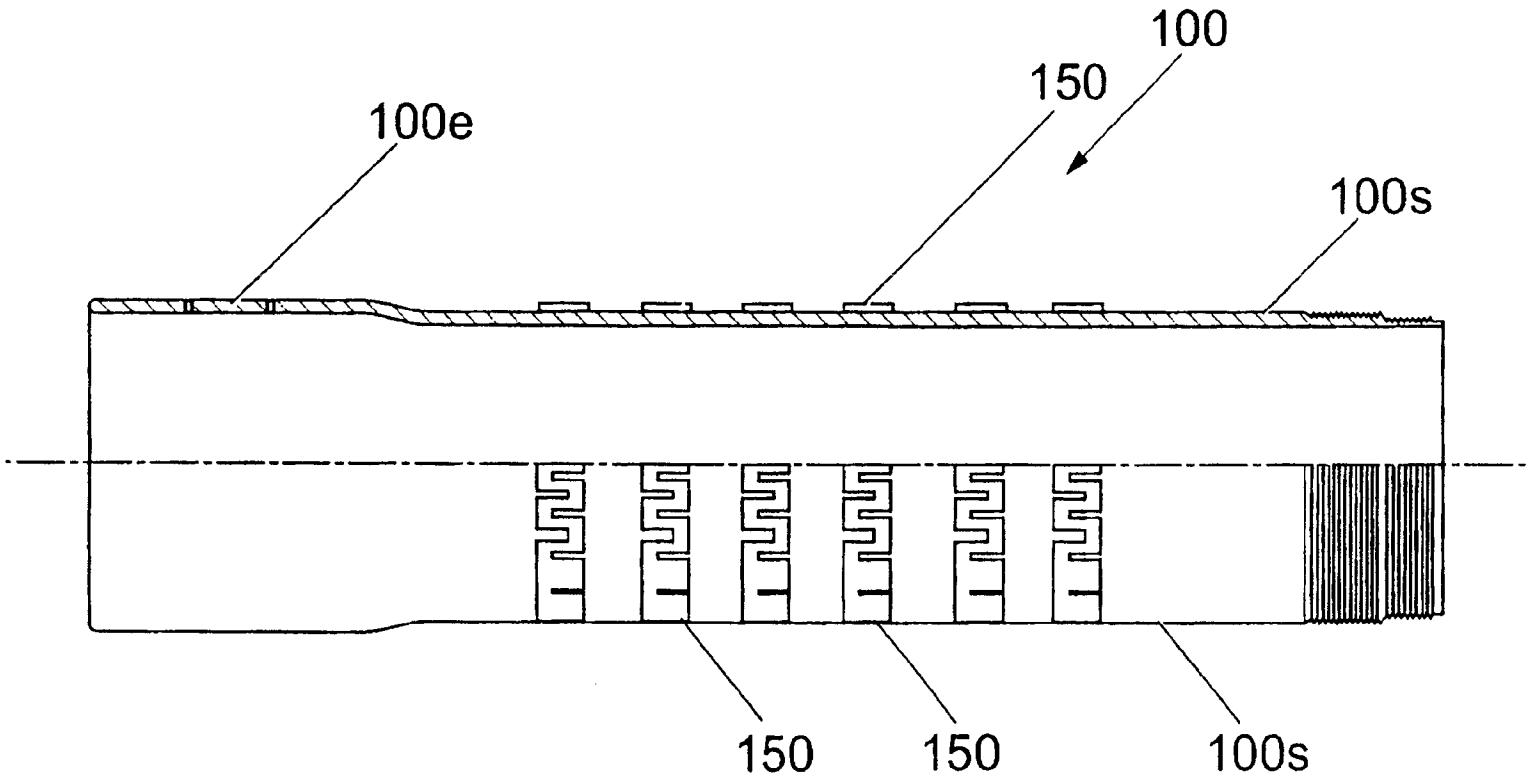
FIG. 3 is a schematic cross-section of an alternative embodiment of apparatus for anchoring an expandable conduit to a borehole having a different formation on an outer surface.

Referring to FIG. 3, there is shown an alternative expandable conduit 100, that is a second embodiment of apparatus of the present invention. Expandable conduit 100 is substantially the same as expandable conduit 12, but has a further alternative formation 150 on an outer surface 100*s* thereof.

The expandable conduit 100 may be any type of suitable conduit that is capable of sustaining plastic deformation whereby it can be radially expanded by at least 10%, although it may be radially expanded by a value more or less than this.

As can be seen from FIG. 3, the expandable conduit 100 is provided with a pre-expanded portion l00*e* in which an expander device (e.g. expander device 18) may be located whilst the conduit 100 is run into a borehole or the like. It should be noted that the expander device need not be located in the conduit 100 whilst it is being run into the borehole, and can be located in the conduit 100 once it is in place.

As shown in FIG. 3, the expandable conduit 100 is provided with at least one formation, generally designated 150. A number of formations 150 are shown applied to the outer surface 100*s* of the conduit 100, each formation being axially spaced from one another by around 12 inches (approximately 305 mm).

Figure 4B:
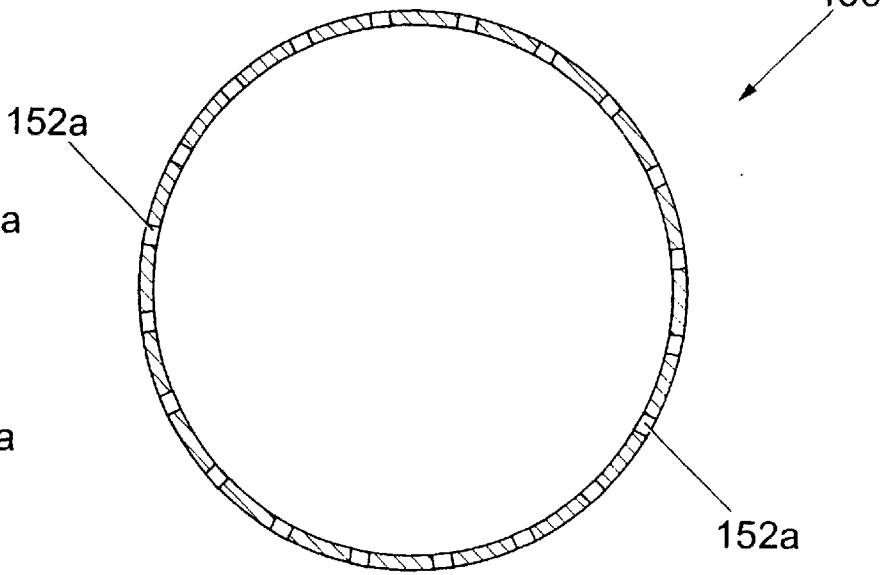
FIG. 4*b* is an end elevation of the formation of FIG. 4*a*.
Figure 4A:
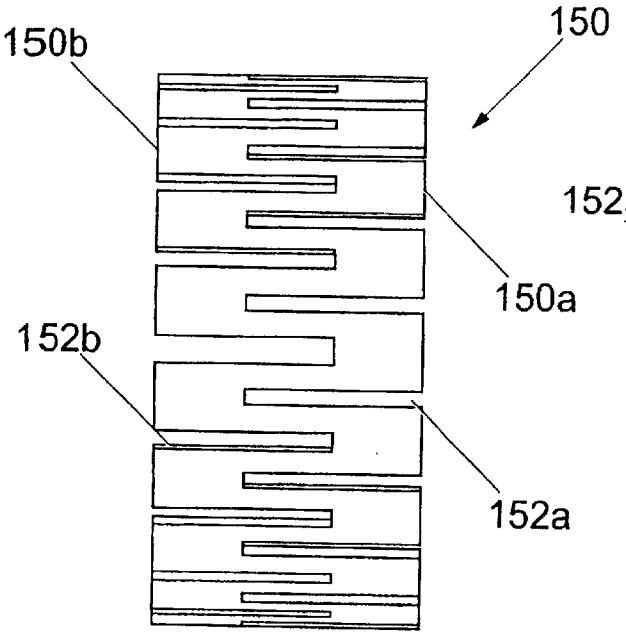
FIG. 4*a* is an front elevation of the formation of FIG. 3.

The formation 150 is best shown in FIGS. 4*a* and 4*b*. The alternative formation 150 is in the form of a zigzag. In this embodiment, the or each formation 150 comprises a single (preferably annular) band of rubber that is, for example, of 90 durometers hardness and is about 2.5 inches (approximately 28 mm) wide by around 0.12 inches (approximately 3 mm) deep.

To provide a zigzag pattern and hence increase the strength of the grip and/or seal that the formation 150 provides in use, a number of slots 152*a*, 152*b* (e.g. 20) are milled into the band of rubber. The slots 152*a*, 152*b* are typically in the order of 0.2 inches (approximately 5 mm) wide by around 2 inches (approximately 50 mm) long.

The slots 152*a* are milled at around 20 circumferentially spaced-apart locations, with around 18° between each along one edge 150*a* of the band. The process is then repeated by milling another 20 slots 152*b* on the other side 150*b* of the band, the slots on the other side being circumferentially offset by 9° from the slots 152*a* on the other side.

In use, the formation 150 is applied to the outer surface 100*s* of the (unexpanded) expandable conduit 100. The formation 150 may be applied at axially spaced-apart locations along the length of the expandable conduit 100, as shown in FIG. 3, the spacings and number of formations 100 being chosen to suit the particular application.

The expandable conduit 100 is then run into a borehole, casing or liner 14, or some other conduit onto which the expandable conduit 100 is to be attached, and is used in substantially the same way as conduit 12 described above.

Using the method and apparatus described herein for anchoring an expandable conduit to a second conduit, it is possible to case a wellbore using an expandable conduit provided with the formation, without the use of cement. This has significant advantages, particularly in terms of cost due to the reduction of materials required and rig down-time.

Thus, there is provided a method and apparatus of anchoring an expandable conduit to a second conduit. Certain embodiments of the apparatus and method optionally provide a seal between the expandable conduit and the second conduit. Certain embodiments of the apparatus include a formation of different layers or bands of resilient materials that are specially arranged and composed to provide a good anchor and/or seal between the expandable conduit and the second conduit.

Modifications and improvements may be made to the foregoing without departing from the scope of the present invention.

What is claimed is:

1. Apparatus for anchoring an expandable conduit, the apparatus comprising at least one formation provided on an outer surface of the expandable conduit, the formation being capable of engaging a second conduit in which the expandable conduit is located, the formation providing at least one of an anchor and a seal for the expandable conduit when the expandable conduit is at least partially expanded, wherein the formation comprises a first band of a first resilient material and a second band of a second resilient material softer than the first resilient material.

2. Apparatus according to claim 1, wherein the formation is applied to the outer surface of the conduit before the conduit is expanded.

3. Apparatus according to claim 1, wherein the formation comprises two or more axially spaced formations.

4. Apparatus according to claim 1, wherein the expandable conduit is temporarily anchored to the second conduit.

5. Apparatus for anchoring an expandable conduit, comprising: at least one formation provided on an outer surface of the expandable conduit, the formation capable of engaging a second conduit in which the expandable conduit is located, the formation providing at least one of an anchor and a seal for the expandable conduit when the expandable conduit is at least partially expanded, wherein the formation comprises first and second bands of a first resilient material axially spaced apart with a third band of a second resilient material located between the first and second bands, wherein the first resilient material is harder than the second resilient material.

6. Apparatus for anchoring an expandable conduit, comprising: at least one formation provided on an outer surface of the expandable conduit, the formation capable of engaging a second conduit in which the expandable conduit is located, the formation providing at least one of an anchor and a seal for the expandable conduit when the expandable conduit is at least partially expanded, wherein the formation comprises first and second bands of a first resilient material axially spaced apart with a third band of a second resilient material located between the first and second bands, wherein at least one of the bands is profiled on an outer surface thereof.

7. Apparatus for anchoring an expandable conduit, comprising: at least one formation provided on an outer surface of the expandable conduit, the formation capable of engaging a second conduit in which the expandable conduit is located, the formation providing at least one of an anchor and a seal for the expandable conduit when the expandable conduit is at least partially expanded, wherein the formation comprises first and second bands of a first resilient material axially spaced apart with a third band of a second resilient material located between the first and second bands, wherein the first resilient material comprises a first rubber, and the second resilient material comprises a second rubber.

8. Apparatus for anchoring an expandable conduit, comprising: at least one formation provided on an outer surface of the expandable conduit, the formation capable of engaging a second conduit in which the expandable conduit is located, the formation providing at least one of an anchor and a seal for the expandable conduit when the expandable conduit is at least partially expanded, wherein the formation comprises a band of resilient material that defines a zigzag pattern on an outer surface of the conduit.

9. An expandable conduit, the conduit having a formation on its outer surface adapted to engage a second member when the expandable conduit is expanded, wherein the formation comprises a first band of a first resilient material and a second band of a second resilient material softer than the first resilient material.

10. An expandable conduit according to claim 9, wherein the formation is applied to the outer surface of the conduit before the conduit is expanded.

11. An expandable conduit according to claim 9, wherein the formation comprises two or more axially spaced formations.

12. An expandable conduit according to claim 9, wherein the expandable conduit is temporarily anchored to the second member using a mechanical anchoring device.

13. An expandable conduit, comprising: a formation on the outer surface of the expandable conduit adapted to engage a second member when the expandable conduit is expanded, wherein the formation comprises first and second bands of a first resilient material axially spaced with a third band of a second resilient material located between the first and second bands, wherein the first resilient material is harder than the second resilient material.

14. An expandable conduit, comprising: a formation on the outer surface of the expandable conduit adapted to engage a second member when the expandable conduit is expanded, wherein the formation comprises first and second bands of a first resilient material axially spaced with a third band of a second resilient material located between the first and second bands, wherein at least one of the first and second resilient bands is profiled on an outer surface thereof.

15. An expandable conduit, comprising: a formation on the outer surface of the expandable conduit adapted to engage a second member when the expandable conduit is expanded, wherein the formation comprises first and second bands of a first resilient material axially spaced with a third band of a second resilient material located between the first and second bands, wherein the first resilient material comprises a first rubber, and the second resilient material comprises a second rubber.

16. An expandable conduit, comprising: a formation on the outer surface of the expandable conduit adapted to engage a second member when the expandable conduit is expanded, wherein the formation comprises a band of resilient material that defines a zigzag pattern on an outer surface of the conduit.

17. A method of anchoring an expandable conduit, comprising: providing an expandable conduit having at least one formation on an outer surface thereof, the formation being capable of engaging a second conduit in which the expandable conduit is located and comprising a first band of a first resilient material and a second band of a second resilient material softer than the first resilient material, anchoring the expandable conduit to the second conduit, and expanding at least a portion of the expandable conduit to force the formation into contact with the second conduit.

18. An expandable conduit assembly, comprising:

a formation disposed on an outside surface of the expandable conduit, the formation comprising an anchor portion and a seal portion; and an additional anchor to temporarily support the assembly before expanding the portion of the expandable conduit whereon the formation is disposed.

19. A method of anchoring an expandable conduit in a member, comprising:

providing an expandable conduit having an additional anchor and a formation on an outer surface thereof, the formation comprising an anchor portion and a seal portion; setting the additional anchor, wherein setting the additional anchor at least temporarily anchors the expandable conduit in the member before expanding the portion of the expandable conduit whereon the formation is disposed; and expanding at least a portion of the expandable conduit to force the formation into contact with the member.

* * * * *

UNITED STATES PATENT AND TRADEMARK OFFICE

CERTIFICATE OF CORRECTION

PATENT NO. : 6,789,622 B1
APPLICATION NO. : 10/069990
DATED : September 14, 2004
INVENTOR(S) : Christopher Ducasse and Peter Oosterling It is certified that error appears in the above-identified patent and that said Letters Patent is hereby corrected as shown below:

TITLE page:
ITEM (73), Assignee, please delete "EZ" and insert --E2--.

Signed and Sealed this

Seventh Day of November, 2006

JON W. DUDAS
*Director of the United States Patent and Trademark Office*